United States Patent [19]

Rothrock

[11] 4,246,974

[45] Jan. 27, 1981

[54] OFFSET DRILLING MACHINE

[75] Inventor: Richard L. Rothrock, Dallas, Tex.

[73] Assignee: BPR Grouting and Engineering, Inc., Dallas, Tex.

[21] Appl. No.: 916,922

[22] Filed: Jun. 19, 1978

[51] Int. Cl.[3] ..... E21B 15/04

[52] U.S. Cl. ..... 173/38; 175/57

[58] Field of Search ..... 173/22, 24, 27, 38, 173/42, 43; 172/118, 119; 37/81, 82

[56] References Cited

U.S. PATENT DOCUMENTS

| | | | |
|---|---|---|---|
| 1,071,477 | 8/1913 | Stowe | 37/82 X |
| 2,217,300 | 10/1940 | Templeton | 173/27 X |
| 2,320,775 | 6/1943 | Garner | 173/38 |
| 2,468,319 | 4/1949 | Adams | 173/38 |
| 2,558,642 | 6/1951 | Clark et al. | 37/81 |
| 2,959,398 | 11/1960 | Troche | 173/38 |
| 4,066,134 | 1/1978 | Karns | 173/27 |

*Primary Examiner*—James A. Leppink
*Assistant Examiner*—Richard E. Favreau
*Attorney, Agent, or Firm*—Larry B. Dwight

[57] ABSTRACT

Apparatus for drilling a pier hole under the ledge of a building foundation to permit lifting the foundation for relevelling of the building, the apparatus having an adjustable drill support frame to drill downwardly. A transmission and drill bit depending from said drill support frame and a crowd bar adapted to move the drill bit under the foundation once the top of the drill bit is has passed the bottom of the foundation. By moving the drill bit under the foundation this permits a more vertical shaft providing better support for the foundation.

4 Claims, 8 Drawing Figures

OFFSET DRILLING MACHINE

BACKGROUND OF THE INVENTION

Residential and small commercial foundations constructed in modern times are generally a concrete slab having a small beam about the periphery and spaced intermittently between the sides of the slab to support the house. As long as upper soil conditions remain stable, the slab provides adequate support for the use intended. However, variations in the moisture content of the supporting sub soil caused by excessive watering of the flower beds adjacent the foundation, poor drainage away from the foundation, leaking plumbing, non-uniform watering of flowers, shrubs or the lawn around the house, or any concentration of water at one or more points around the foundation or extremes in climatic conditions (dry summer, wet winter) cause expansive soils such as clay to either exert a pressure upwardly on the foundation or dry and lose strength thus causing the slab to crack and and become unlevel.

Once the foundation is cracked, it becomes unlevel and causes cracks in the masonry and interior walls of the house which are unattractive and allow needless escape of heated or cooled air from the home.

Although not as suspectible if properly constructed pier and beam foundations are also subject to moving and becoming unlevel if the piers do not extend to bed rock.

Heretofore, attempts to correct the levelling problem have been achieved by two methods. The first method is commonly called mud-jacking wherein a soil cement grout is pumped beneath the slab, under pressure, to produce a lifting force which literally floats the slab to the desired position. Introduction of the grout through small holes in the slab allows lifting of a portion of the slab.

A second method, which is often combined with mud-jacking is mechanically raising of the slab and back filling with the soil cement grout. The mechanical method represents a certain improvement over the pressure injection however, it is generally limited to the perimeter of the beam due to accessibility of equipment.

Heretofore, drilling holes about the perimeter of the beam to allow mechanical lifting of slab has been achieved by placing the drill as close to the foundation as possible and drilling under the foundation. Because of the equipment heretofore devised, the drill generally projects under the beam at a 30 to 45 degree angle. This is undesirable in that only the vertical components directly under the beam provide support for the foundation.

It has been found that in order to properly correct the problem of a settling foundation one must drill below the unstabilized soil. Soil becomes stable at a distance of only 7 to 8 feet below the ground and is generally unstable above that heighth and therefore it is necessary to drill 7 to 8 feet below the foundation level in order to provide proper support to prevent further collapsing of the foundation. This distance may vary depending upon the type of soil in the area, however, this figure is generally true for clay type soils found in black lands.

SUMMARY

My invention is directed toward apparatus for allowing drilling beside a foundation to provide a substantially vertical hole under the foundation edge which goes below the unstable soil into a stabilized support.

The apparatus generally comprises a front loading type vehicle having a hydraulically actuated arm pivotally secured to and controlling a support frame. The support frame supports a horizontally adjustable connector member which secures the transmission and drive member to the frame. The transmission drives a drill bit having a shaft connected to the transmission.

The improvement generally comprises a rigid crowd bar secured between the drive vehicle and shaft of the drill bit such that by moving the vehicle while drilling the drill bit may be moved horizontally in the ground to move under the foundation. The drill head controls vertical movement of the drill bit.

The first hole dug generally comprises a drill bit twice the diameter of the second bit to be used to drill the pier which is usually 10–12 inches. In addition, the bit is approximately 2 feet long and is placed adjacent the foundation and moved downwardly until the upper edge of the drill bit is level with the bottom edge of the foundation. By moving the vehicle inwardly toward the building, the crowd bar and the drill bit are moved horizontally under the foundation forming an oblong type hole under the foundation. This provides a hole large enough for insertion of jacks and other equipment later and in addition provides a hole long enough to inserts a longer downwardly extending bit.

The longer bit is placed on the transmission and in the crowd bar secured thereto. The long drill bit is placed within the hole as nearly vertical as possible and is started downwardly. The drill is generally long enough to penetrate the unstable soil and go into the stable soil. As the bit is forced downwardly by the crowd bar directs the bit under the foundation.

Once the hole is dug the pier is poured with concrete up to one foot past the level of the large hole. After the concrete is cured, a jack is placed between the pier and the bottom ledge of the foundation wherein the foundation is jacked upwardly then a grout mixture is mixed and shoved under the foundation under pressure and provides future support. The jack is then removed and concrete is placed between the top of the pier and the bottom of the ledge.

A primary object of the invention is to provide apparatus to drill a generally vertical hole under a foundation to provide adequate support for the foundation.

A still further object of the invention is to provide a crowd bar which allows horizontal movement of a bit once it moves under the foundation to more nearly provide a vertical hole to stable soil.

A still further object of the invention is to provide apparatus which will move in a generally limited area and under a limited vertical space of the eave of the house such that a vertical hole may be drilled to allow placement of a pier under the ledge of the foundation.

Other and further objects of the invention will become apparent upon studying the detailed description hereinafter following and the drawings annexed hereto.

DESCRIPTION OF THE DRAWINGS

The drawings of a preferred embodiment of the invention are annexed hereto so that the invention may be better and more fully understood, in which.

Numeral references are used to designate like parts throughout the various figures of the drawing.

DESCRIPTION OF A PREFERRED EMBODIMENT

Figure 8:
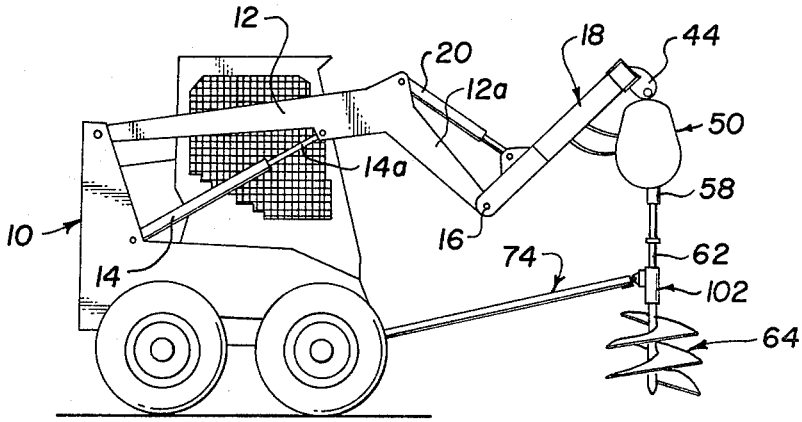
FIG. 8 is an elevational view of the vehicle.

The numeral 10 generally designates the drive vehicle which although may be of several configurations preferably of a type such as that manufactured by Clark Equipment Company of Fargo, N. Dak. Model 825 Hydrostatic Front Loading Four-Wheel Drive Skid Steer Unit (FIG. 8).

The unit generally has main support arms 12 pivotally secured to the rear of the unit and actuating means such as cylinders 14 for raising and lowering the arms 12. Arms 12 have a deflected portion 12*a* which is pivotally secured by pin 16 to a support frame 18.

Means to lower and raise support frame 18 generally comprises a pair of hydraulic cylinders 20 having a first end pivotally secured by pin 22 to clevis 24 on arm 12 and a second end pivotally secured by pin 26 to clevis 28 on support frame 18.

Figure 1:
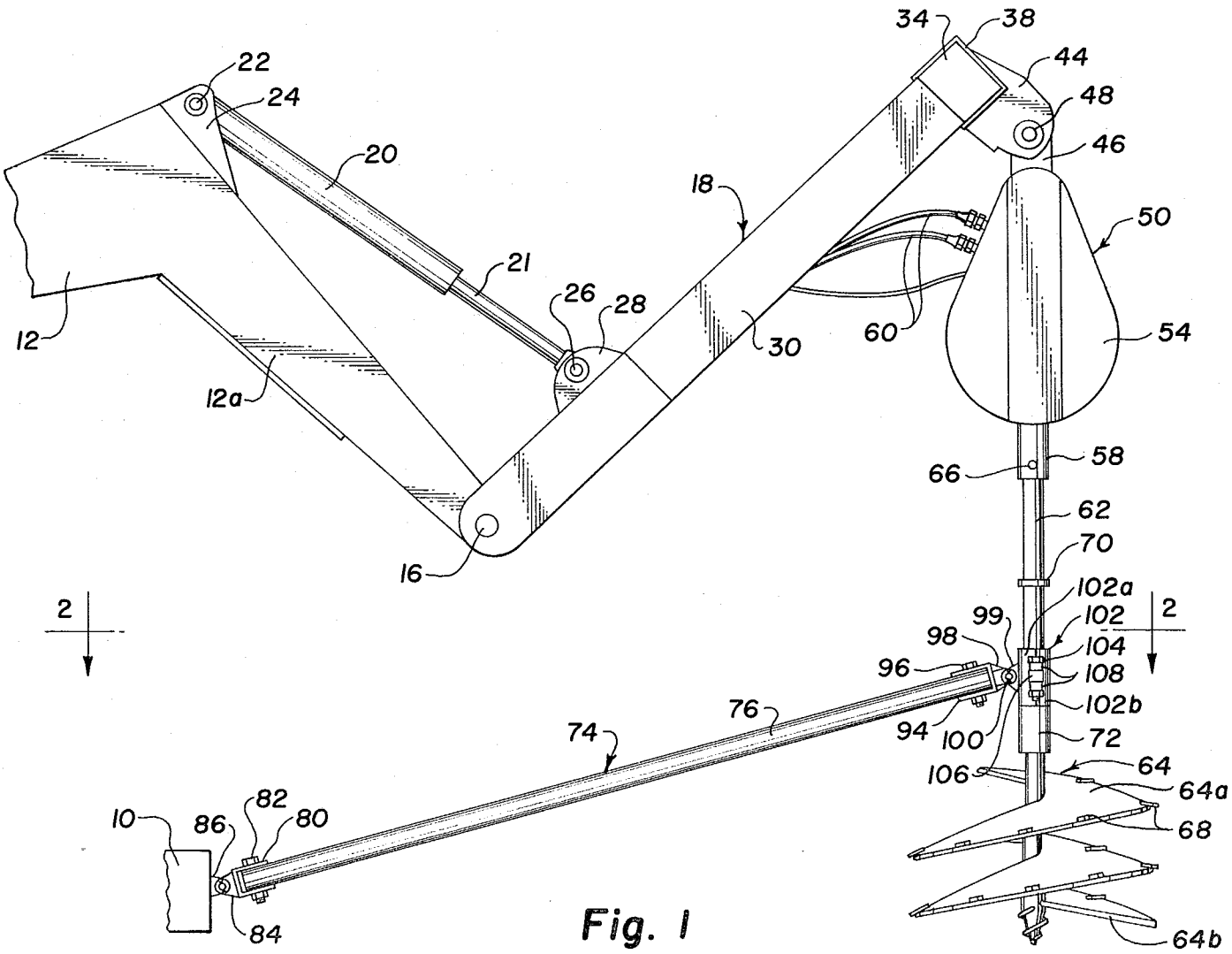
FIG. 1 is side elevational view of the drill.
Figure 2:
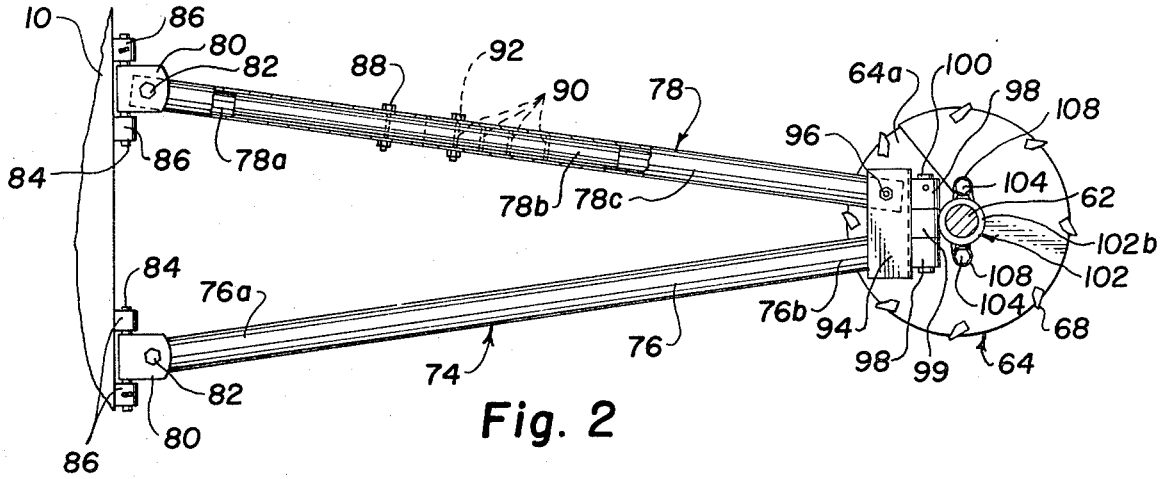
FIG. 2 is a cross-sectional view taken along line 2—2 of FIG. 1.
Figure 3:
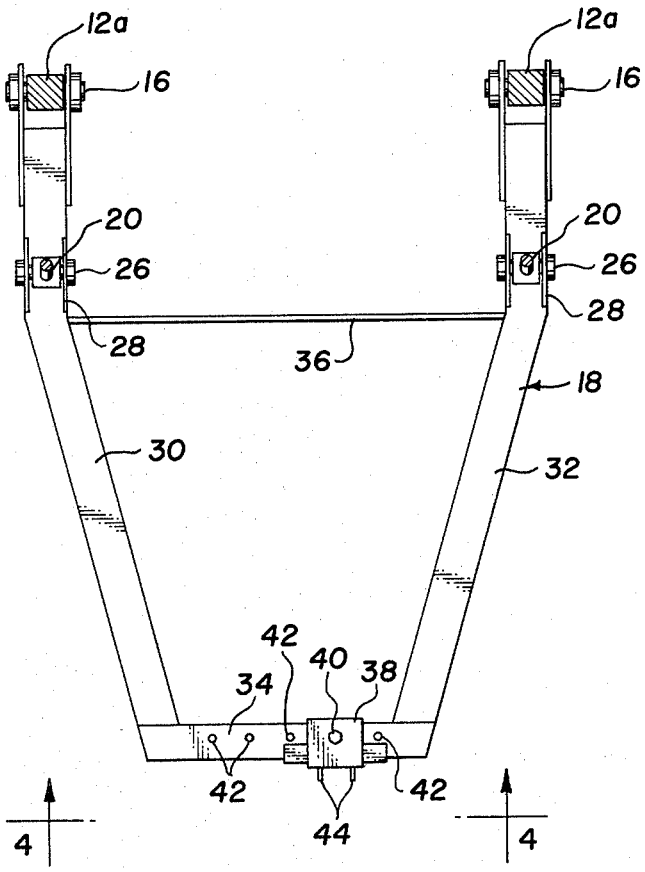
FIG. 3 is a cross-sectional view taken along line 3—3 of FIG. 1.
Figure 4:
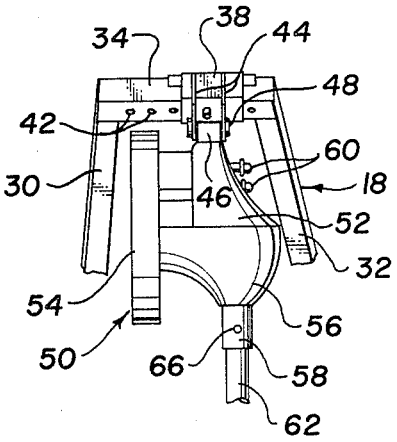
FIG. 4 is a cross-sectional view taken along line 4—4 of FIG. 4 with parts broken away to more clearly illustrate the details of construction.

As best illustrated in FIG. 3, support frame 18 generally comprises an A frame have side members 30 and 32 welded or otherwise secured to a cross-member 34 at the head of frame 18 and a secondary cross-member 36 secured between side members 30 and 32 at a central position.

A source of hydraulic power is generally provided by the drive vehicle 10 and controls (not shown) are provided to extend and retract rods 21 of cylinders 20 to raise and lower frame 18. Similar controls are provided to extend or retract rod 14*a* of cylinder 14 to raise and lower the main support arm 12 on vehicle 10.

Means such as slide member 38 slideably disposed on cross-member 34 and adjustably positioned between side members 30 and 32 by bolt 40 secured through aligned passages 42 formed in cross-member 34. Clevis 44 provides a support for a member 46 secured by pin 48 to the clevis 44 to support transmission 50. Member 46 allows transmission 50 to be turned providing adjustment means to turn the transmission to the desired location and horizontally adjust the angle of the transmission.

The drive mechanism transmission 50 generally comprises a hydraulic motor 52 connected by a gear reduction 54 to a differential 56 to provide output to shaft 58. Hydraulic connection lines 60 are provided for connection to controls (not shown) to provide power to output shaft 58.

Shaft 58 is generally a hollow type adapted to receive the upper end of a shaft 62 of drill bit 64.

Means to secure the shaft 62 to output shaft 58 generally comprises a pin 66.

Drill bit 64 may be of varying sizes and diameters for instance the first drill bit would preferably be approximately two feet in heighth from the top 64*a* to the bottom 64*b* and have a diameter of approximately 24 inches. In addition, drill bit 64 preferably teeth 68 welded or otherwise secured thereto and have tungsten carbide brazing applied to the teeth 68 to allow side cutting into the soil and reduce wear of the bit 64. An upward limit flange 70 provides means to limit upwardly movement of the crowd bar to be more fully explained hereinafter and a lower limit flange 72 provides a lower limit.

Means to crowd the drill bit 64 under the foundation F generally comprises a crowd bar generally designated 74 having a first rigid bar 76 and a second adjustable bar 78. The first end 76*a* of bar 76 is horizontally pivotally secured in clevis 80 by bolt 82 and clevis 80 is pivotally secured by pin 84 between bushing blocks 86 rigidly secured to the front lower end of vehicle 10.

Adjustable rigid bar 78 comprises a first member 78*a* which is pivotally secured in a horizontal direction by pin 82 to clevis 80 which is pivotally secured by a pin 84 in bushing blocks 86 rigidly secured to the front of loader 10. A second member 78*b* is secured to first member 78*a* by bolt 88 and has a plurality of aligned passages 90 formed in the second end to receive bolt 92. A third member 78*c* is slideably disposed on second member 78*b* such that it may be lengthened by removing bolt 92 and moving the passage outwardly to be aligned with one of the other aligned passages 90 in member 78*b*. By adjusting the length of arm 78, bit 64 may be moved to either side of vehicle 10 to allow alignment with the side of the vehicle to position the vehicle 10 and bit 64 closer to the building.

Clamp member 94 is welded or otherwise rigidly secured to end 76*b* of rigid member 76 and is bolted and pivotally secured by bolt 96 to the end of third member 78*c*. Hinge members 98 are welded to clamp member 94 to receive hinge member 99 and pin 100. Hinge member 99 is welded to cylindrically shaped slide member 102 secured about shaft 62. Slide member 102 generally comprises a first half 102*a* and second half 102*b*. Halves 102*a* and 102*b* are secured by a bolt 104 passing through hinge members 106 and 108 secured to each half respectively. Thus, by removing a single bolt 104 half 102*b* may be pivotally outward for removal of shaft 62.

Figure 5:
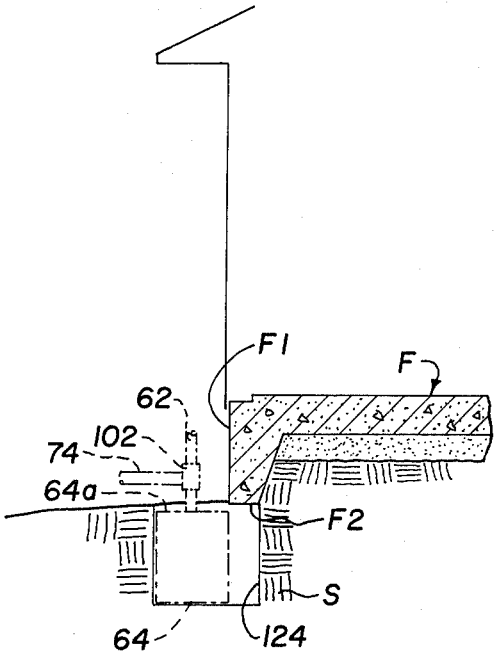
FIG. 5 is a diagrammatic illustration of the hole being placed under the foundation.

Operation of the hereinbefore described device is as follows:

As illustrated in FIG. 5 the foundation generally designated F has a side F1 and bottom ledge F2. The soil S generally supports the foundation F.

Figure 7:
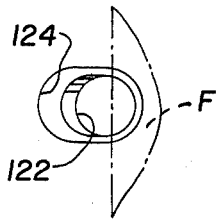
FIG. 7 is a cross-sectional view taken along line 7—7 of FIG. 6.
Figure 6:
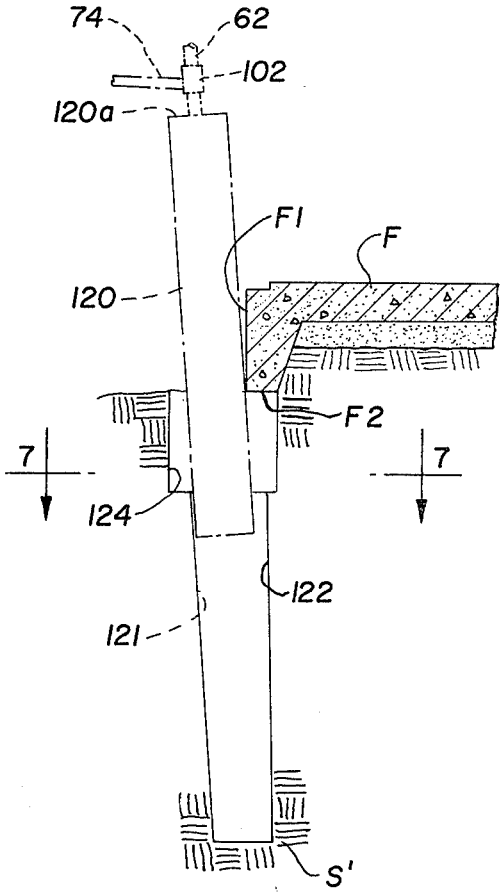
FIG. 6 is a diagrammatic illustration similar to FIG. 5.

The first step is to insert the large diameter short bit 64 into the drilling rig. The vehicle 10 is manuevered close to the house. Since the vehicle 10 is preferably a four-wheel drive vehicle, the unit may be parallel to the side of the house or if room permits the vehicle 10 is aligned perpendicular to the house. The drill bit 64 is moved down the side F1 of the foundation F until the upper edge 64*a* is level with the bottom ledge F2 of the foundation. The vehicle 10 is then moved to force crowd bar 74 in a direction generally toward the side F1 of the foundation causing the drill bit 64 to move under the ledge F2 of the foundation. Once the bit is moved as close as possible to the side F1 of the foundation F, the bit is then withdrawn and removed. A smaller diameter bit, for instance 12 inches, having a longer length, for instance 8 feet, generally designated 120 is then secured to the drilling output shaft 58. Since the bit is considerably longer a certain amount bias will naturally be existant on the outside edge 121 of hole 122. However, the larger hole 124 provides adequate room to attempt to get a substantially vertical start on drill bit 120. As the drill bit moves its upper edge 120*a* past the bottom ledge F2 it may be forced under the ledge F2 by crowd bar 74 if desired. However, from FIG. 7 it should be readily apparent that hole 122 is substantially vertical and extends into stable soil S'.

Once hole 122 is dug it is filled with concrete up to one foot past the level of large hole 124 to form a cap. A jack is placed on the pier thus formed, after the concrete is cured, to raise ledge F2 upwardly. Grout is forced by pressure under the foundation into the void created by lifting the foundation. Once the grout is hardened the jack is removed and the pier is extended upwardly to extend under ledge F2. This provides a stable support for the foundation and if necessary the short pier between the top of hole 122 and ledge F2 may be removed for future jacking if deemed necessary.

Adjustable arm 78 may be adjusted to move the base of bit 64 to be aligned with the left or right side of vehicle 10. Also, slide member 38 is likewise moved along cross-member 34 to the left or right to align the top of transmission 50 with the bit 50. In addition, if uneven terrain is encountered slide member 38 may be adjusted such that the bit 64 is positioned at a slight angle relative to vehicle 10 to compensate for the sloping ground and thus maintain hole 124 as nearly vertical to the house as possible. It should be readily apparent that by adjusting slide member 38 and arm 78 various angles and positions of bit 64 may be achieved. By moving bit 64 to one side the vehicle 10 may be positioned parallel to the wall of the building when property lines are very close.

It should be apparent from the foregoing that the invention accomplishes the objects of the invention hereinbefore discussed.

Having described my invention, I claim:

1. Apparatus for boring a vertical hole under the edge of a foundation comprising: a support vehicle; auger drives means operably secured to said support vehicle; an auger operably secured to said auger drive means; an outwardly extending arm secured to said support vehicle; means to raise and lower said arm; a support frame pivotally secured to the end of said outwardly extending arm, said support frame having said auger drive means secured to an outer end thereof; means operably secured to said support frame to raise and lower said support frame to control the position of said auger; and crowd bar means having a first end pivotally secured to said support vehicle and a second end slideably secured to said auger, said crowd bar means adapted to urge said auger horizontally as said support vehicle is moved.

2. Apparatus according to claim 1, wherein said auger drive means is moveably secured to said support frame.

3. Apparatus according to claim 1, wherein said crowd bar means comprises: a first rigid bar having a first end pivotally secured to said support vehicle; an adjustable rigid bar having a first end secured to said support vehicle; means pivotally securing said rigid bar and said adjustable bar together at the second ends thereof; and means slideably securing said second ends to said crowd bar to a shaft on said auger.

4. Apparatus according to claim 1, wherein said drive means comprises: a hydraulically driven motor; and transmission means to secure said motor to said auger.

* * * * *